US011158954B2

(12) United States Patent
Bieti

(10) Patent No.: US 11,158,954 B2
(45) Date of Patent: Oct. 26, 2021

(54) DIELECTRICALLY LOADED WAVEGUIDE HEMISPHERICAL ANTENNA

(71) Applicant: The Boeing Company, Chicago, IL (US)

(72) Inventor: Martin W. Bieti, El Segundo, CA (US)

(73) Assignee: The Boeing Company, Chicago, IL (US)

( * ) Notice: Subject to any disclaimer, the term of this patent is extended or adjusted under 35 U.S.C. 154(b) by 243 days.

(21) Appl. No.: 16/153,666

(22) Filed: Oct. 5, 2018

(65) Prior Publication Data

US 2020/0112104 A1 Apr. 9, 2020

(51) Int. Cl.
*H01Q 15/08* (2006.01)
*H01Q 19/08* (2006.01)
*H01Q 13/06* (2006.01)

(52) U.S. Cl.
CPC ..... *H01Q 15/08* (2013.01); *H01Q 13/06* (2013.01); *H01Q 19/08* (2013.01)

(58) Field of Classification Search
CPC .. H01Q 1/48; H01Q 13/0225; H01Q 13/0241; H01Q 13/0266; H01Q 13/06; H01Q 13/065; H01Q 13/08; H01Q 15/02; H01Q 15/04; H01Q 15/08; H01Q 19/06; H01Q 19/062; H01Q 19/08; H01Q 19/09
See application file for complete search history.

(56) References Cited

U.S. PATENT DOCUMENTS 2,761,138 A * 8/1956 Sherman ..... H01Q 13/04 343/781 R
2004/0108963 A1* 6/2004 Clymer ..... H01Q 3/08 343/837

OTHER PUBLICATIONS

Kumar, A., "Hemispherical Coverage Antenna for Spacecraft," published in IEEE Electronics Letters, vol. 24 No. 10, May 12, 1988, 3 pages.
Wong, Gary G., "A Novel Hemispherical Coverage Waveguide Antenna," published in the 1976 IEEE Antennas and Propagation Society International Symposium, Oct. 11-15, 1976, 4 pages.
Sivareddy, et al., "Ku-Band Omni Antenna System for Satellite TTC," published in the 2011 IEEE Applied Electromagnetics Conference, Dec. 18-22, 2011, 4 pages.
Wohlleben, et al., "Simple Small Primary Feed for Large Opening Angles and High Aperture Efficiency," published in IEEE Electronics Letters vol. 8, Issue 19, Sep. 21, 1972, 3 pages.

* cited by examiner

*Primary Examiner* — Robert Karacsony

(57) ABSTRACT

A hemispherical antenna includes a ground plane having a circular waveguide. A dielectric lens is coupled to the ground plane. The dielectric lens has a tapered end opposite to an end coupled to the ground plane. The dielectric lens does not include a parasitic crossed-dipole element. The hemispherical antenna is scalable in size for operation at higher operating frequencies.

20 Claims, 7 Drawing Sheets

DIELECTRICALLY LOADED WAVEGUIDE HEMISPHERICAL ANTENNA

BACKGROUND

Hemispherical antennas are used in different applications. For example, wireless network communications that provide high-speed, high-performance global communications infrastructure include at least one satellite constellation comprised of a plurality of satellites that each emit a hemispherical radiation pattern. Manufacture, assembly, and deployment of known hemispherical antenna designs configured to operate in the high microwave frequency bands (e.g., the Ka-band) for such satellites is not readily practicable, cost-effective, or reliable. In particular, such configurations result in extremely small components (e.g., ground plane, dielectric support, and parasitic crossed-dipole) dimensions, such that the components become so thin that antenna construction, assembly, and deployment have increased difficulty, cost, and errors. Additionally, the resultant antennas suffer increased fragility and unreliability over the operational lifetimes of these antennas. The total number of parts is also higher, further increasing complexity. Moreover, when existing hemispherical antenna designs that are configured to operate in the high microwave frequency bands are scaled up to more realizable sizes, negative antenna performance impacts often occur.

A choke-pipe hemispherical antenna design is more realizable than the hemispherical antenna design for operation at high microwave frequencies due to its simpler construction. However, such choke-pipe hemispherical antennas are constrained to a significantly lesser gain at large field of view angles relative to the beam axis of the antenna. This reduced gain results in choke-pipe hemispherical antennas being unsuitable for use in many applications, such as a high-speed, high-performance wireless communications network or spacecraft command and control.

Thus, existing hemispherical antenna designs and choke-pipe hemispherical antenna designs cannot satisfactorily provide a hemispherical radiation pattern and gain combination suitable for high frequency band antennas, such as for use in modern communications satellite transmission and reception, or spacecraft telemetry and command applications.

SUMMARY

Some examples provide a hemispherical antenna that includes a ground plane. The ground plane has a circular waveguide. A dielectric lens is coupled to the ground plane. The dielectric lens has a tapered end opposite to an end coupled to the ground plane.

Other examples provide a hemispherical antenna that includes a ground plane. The ground plane has a circular waveguide. A single dielectric lens is coupled to the ground plane. The single dielectric lens does not include a parasitic crossed-dipole element.

Still other examples provide a method for manufacturing a hemispherical antenna. The method includes providing a ground plane having a circular waveguide, providing a dielectric lens, and coupling the dielectric lens to the ground plane. The dielectric lens has a tapered end opposite to an end coupled to the ground plane.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

Corresponding reference characters indicate corresponding parts throughout the drawings.

DETAILED DESCRIPTION

Figure 1:
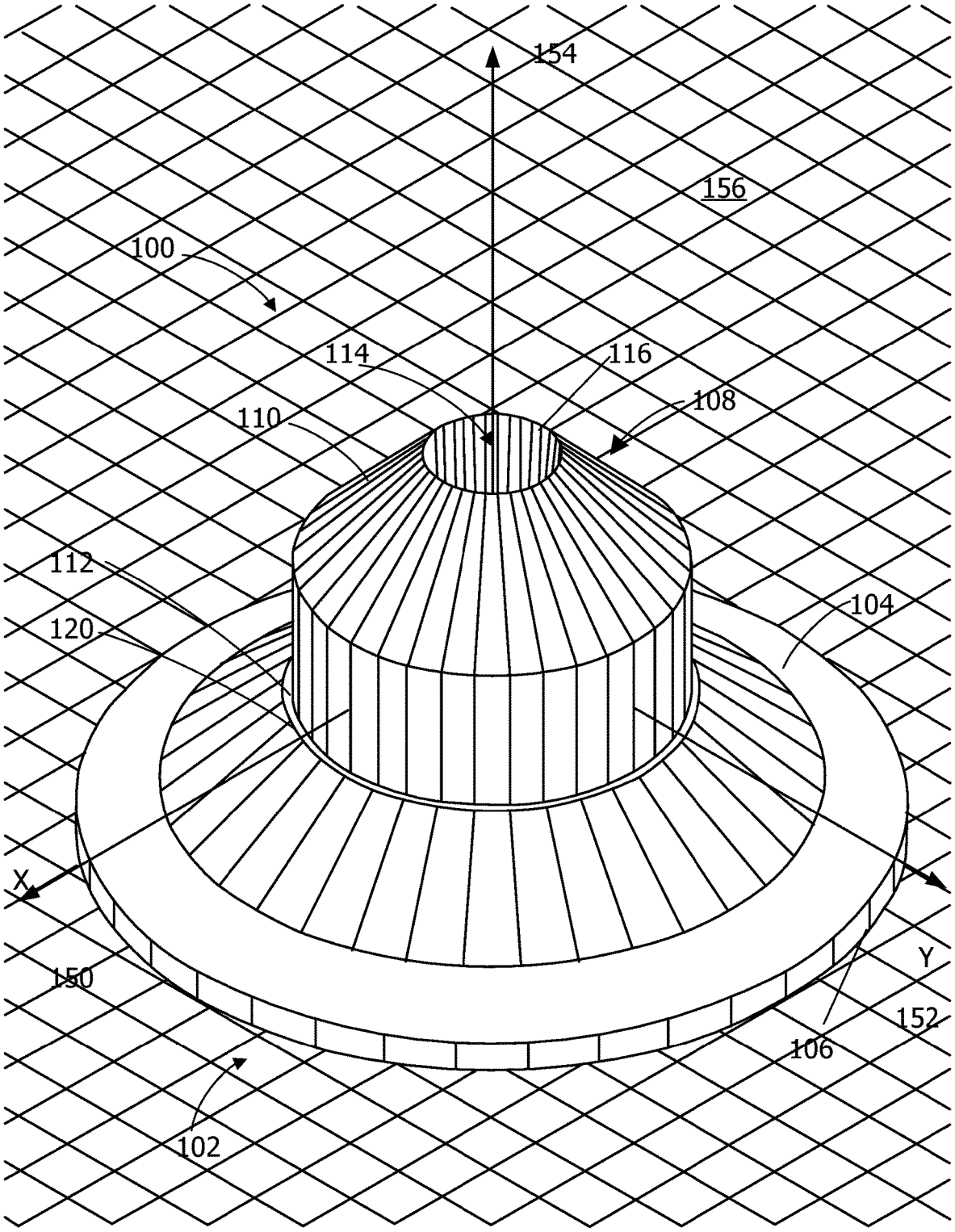
FIG. 1 is a perspective view illustrating a hemispherical antenna according to an embodiment of the present disclosure.

Referring to the figures, some examples of the disclosure provide a hemispherical antenna, which can be configured as a dielectrically loaded waveguide hemispherical antenna, that operates within the high microwave frequency bands. For example, various examples operate to establish and maintain wireless communications sufficient to support a high-speed, high-performance global communications infrastructure, and/or provide spacecraft telemetry and command system operations. Such frequency bands include, but are not limited to, the Ka-band (26.5 GHz-40 GHz) and the V-band (40 GHz-75 GHz). The Ka-band and V-band are used in such existing applications, but are also applicable to other applications, such as next-generation wireless communications networks. Such next-generation wireless communications networks include, for example, fifth-generation (5G) mobile communications systems utilizing the Ka-band, and the SES Networks O3B NETWORKS® mPOWER satellite-based communications network utilizing the Ka-Band.

A hemispherical antenna according to various examples of the present disclosure has a broad one-hundred-and-eighty-degree radiation pattern coverage, which can be useful in allowing telemetry and command signals to be accessible from any direction. The hemispherical antenna in various examples does not include a parasitic crossed-dipole element or dielectric support element, and results in dimensions that are more readily realizable using conventional machining techniques. The hemispherical antenna of various examples uses at least one dielectric lens. The herein described antenna configurations that have an absence of the dielectric support and parasitic crossed-dipole element, allow scaling of the hemispherical antenna to operate in high microwave frequency bands, thereby reducing or eliminating such problems in conventional designs (e.g., having a very small and thin crossed-dipole element). Examples of the hemispherical antenna are also configured to operate in high microwave frequency bands and realizable when scaled to larger sizes, without negative performance impacts.

Use of a dielectric lens and removal of the dielectric support and parasitic crossed-dipole element also avoids manufacture, assembly, and deployment issues, such as increased costs and errors, as well as antenna fragility and unreliability when configured to operate within the high microwave frequency bands discussed herein. One or more examples of the disclosed hemispherical antenna is held in place proximate to the ground plane with a snap-fit ridge and groove assembly and/or a bonding agent. Manufacture, assembly, and deployment difficulty, costs, and time are thereby reduced, and the assembled hemispherical antenna remains more robust and more reliable over the entire operational lifetime of the antenna. This is advantageous, for example, when the hemispherical antenna is deployed into an extremely harsh and unforgiving environment (e.g., the vacuum of space)

Further, examples of the hemispherical antenna provide a combination of radiation pattern coverage and high gain commensurate with the performance of existing hemispherical antenna designs configured to operate in the high microwave frequency bands. The hemispherical antenna thereby has improved performance to choke-pipe hemispherical antenna designs, which cannot deliver commensurate high gain when configured to operate within high microwave frequency bands and deliver hemispherical radiation pattern coverage. Examples of the hemispherical antenna provide a hemispherical radiation pattern and gain combination suitable for high microwave frequency band antennas, such as intended to provide modern communications satellite telemetry and command capability.

The elements described herein operate in an unconventional manner to create a broad, high-gain hemispherical radiation pattern. Typical examples of dielectrically loaded waveguide non-hemispherical antennas are used to focus a radiation pattern and provide higher antenna gain on or proximate the beam axis of the antenna. One or more examples of a dielectrically loaded waveguide hemispherical antenna of the present disclosure do the opposite by facilitating higher antenna gain off the beam axis of the antenna, thus creating a broad, high-gain hemispheric radiation pattern. The performance of various examples of the dielectrically loaded waveguide hemispherical antenna disclosed herein, as measured by gain and radiation pattern breadth, substantially equals or exceeds conventional existing contemporary hemispherical antenna designs that rely on parasitic crossed-dipole and dielectric support components to function. Various examples will now be described.

Figure 2:
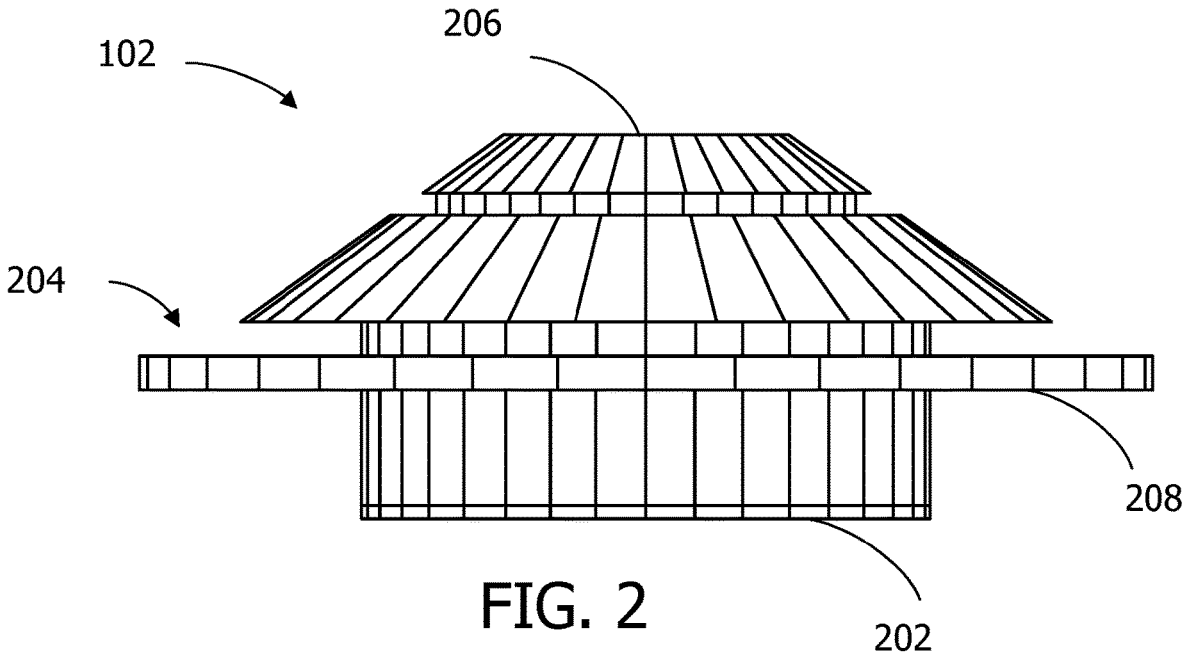
FIG. 2 is a side elevational view illustrating a ground plane having a circular waveguide according to an embodiment of the present disclosure.
Figure 3:
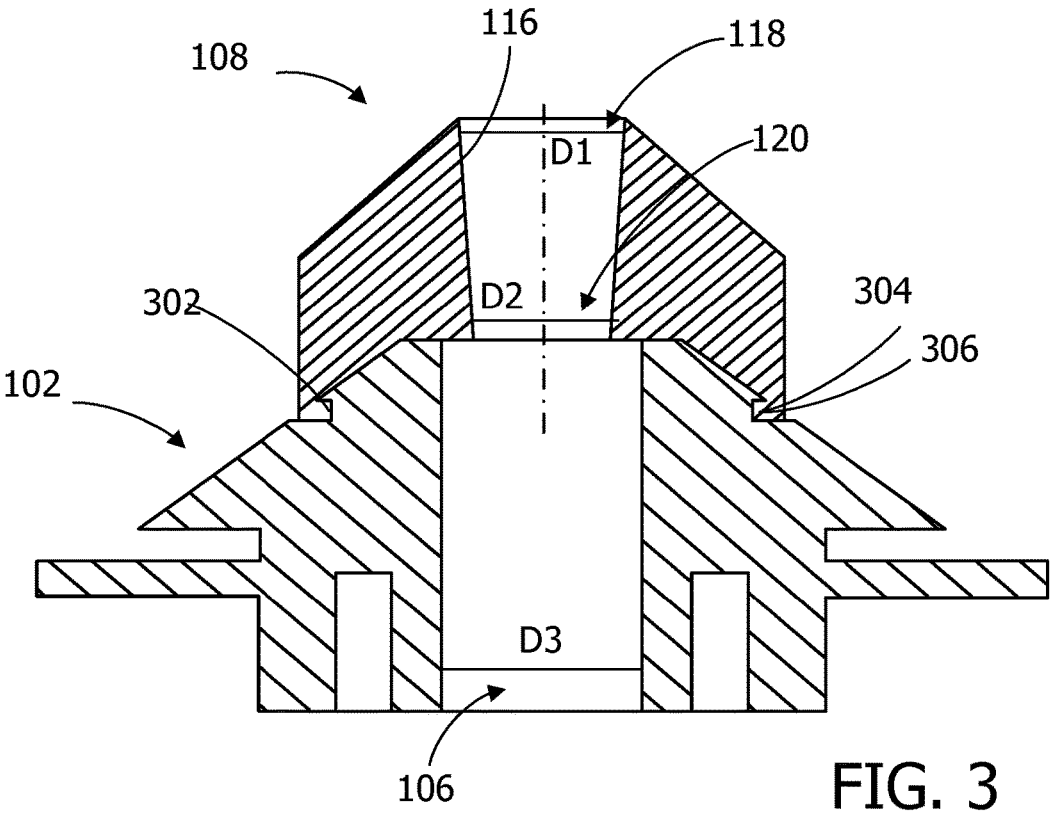
FIG. 3 is a side elevational cutaway view illustrating a dielectric lens having a retaining ridge in abutting engagement with a ground plane having a groove according to an embodiment of the present disclosure.

Referring to FIGS. 1-3, a hemispherical antenna 100, which in various examples is a dielectrically loaded waveguide hemispherical antenna, includes a ground plane 102 having a circular waveguide 104 and a dielectric lens 108. The ground plane 102 is comprised of a conductive material that provides low-impedance earth. The circular waveguide 104 in some examples is a transmission line having a hollow conductor shaped appropriately for a particular application of the hemispherical antenna 100. The circular waveguide 104 guides electromagnetic waves propagated along a length thereof. During such propagation, the waves are reflected by the internal walls of the circular waveguide 104.

The dielectric lens 108 in various examples is a specific subspecies of a lens antenna. The dielectric lens 108 in various examples is a three-dimensional electromagnetic device that has a refractive index other than unity, which is configured in as an electromagnetic lens along with a feed. The dielectric lens 108 is capable of, among other functions, generating a plane wave front from a spherical wave front; forming an incoming wave front at its focus; generating directional characteristics; collimating electromagnetic rays; and controlling aperture illumination in various examples. The dielectric lens 108 in some examples functions by accepting a spherical wave front produced by a primary feed (the primary feed is the circular waveguide 104 in the illustrated example), and converting the spherical wave front into a plane wave front.

The dielectric lens 108 of the hemispherical antenna 100 is configured to behave in an unconventional way. Specifically, the dielectric lens 108 is configured to accomplish the opposite effect compared to the conventional behavior of dielectric lenses generally as discussed above. The dielectric lens 108 generates a hemispherical radiation pattern coverage area from the non-hemispherical radiation delivered by the circular waveguide 104 to the dielectric lens 108. This configuration and operation facilitates higher antenna gain off the beam axis of the antenna, to create a broad, high-gain hemispheric radiation pattern for reception and or transmission, depending on the intended application. This unconventional behavior provides the advantages and benefits of various examples of the present disclosure.

The dielectric lens 108 is coupled to the ground plane 102, which can be accomplished using different coupling arrangements as described herein. In the illustrated example, the dielectric lens 108 has a tapered end 110 opposite to an end 112 coupled to the ground plane 102. That is, one end of the dielectric lens 108 is tapered while the other end has a constant diameter. The tapering of the tapered end 110 extends along a portion of the dielectric lens 108. Although the illustrated embodiment has the tapered end 110 having a taper extending about half the length of the dielectric lens 108, the taper can extend a greater or lesser amount. Additionally, the angle of the taper of the tapered end 110 can be varied, such as based on the particular application. As can be seen in the illustrated example, the tapered end 110 has a tapered outer wall that ends at the end 112, which has a generally planar outer wall, thereby defining a tubular structure in some examples. It should be appreciated that variations and modifications are contemplated, such as different tapered portions having different tapering angles.

In some examples, an aperture 114 of the dielectric lens 108 has a tapered wall 116 with a first diameter (D1) 118 at the tapered end 110 and a second diameter (D2) 120 (D2) at the end 112 coupled to the ground plane 102 (as seen more clearly in FIG. 3). In some examples, the first diameter 118 is less than the second diameter 120. Additionally, in some such examples, a diameter (D3) 106 of the circular waveguide 104 is greater than the second diameter 120 of the dielectric lens 108 (as seen more clearly in FIG. 3), thereby providing an overhang or shoulder type configuration between the ground plane 102 and the dielectric lens 108. This arrangement of the ground plane 102, the circular waveguide 104, and the dielectric lens 108 allows the ground plane 102, the circular waveguide 104, and the dielectric lens 108 to operate together to provide high gain, high microwave frequency band hemispherical radiation coverage, such as for transmission- and or reception-based applications. However, as should be appreciated, different configurations are contemplated, such as the second diameter 120 of the tapered wall 116 having a same diameter as the diameter 106 of the circular waveguide 104.

It should be noted that in the illustrated drawings, the ground plane 102 is understood to be intersected at the center of the ground plane 102 by an x-axis 150, a y-axis 152, and a z-axis 154. Collectively, the x-axis 150, the y-axis 152, and the z-axis 154 are referred to herein as "the axes." In some examples, the axes are used as references to indicate locations of certain features of the ground plane 102.

Thus, a single dielectric lens 108 is configured to operate to generate the hemispherical radiation pattern coverage area without the use of a parasitic crossed-dipole element. That is, the hemispherical antenna 100 is in some examples is configured to operate within only the dielectric lens 108 and no parasitic crossed-dipole element.

It should be appreciated that other variations are contemplated by the present disclosure. For example, the hemispherical antenna 100 can have different multi-tier configurations. Thus, while in the illustrated example, the configuration defines a top hat-shaped profile for the hemispherical antenna 100, other profile shapes are contemplated.

Referring particularly to FIG. 2 (with continued reference to FIGS. 1 and 3), a side elevational view illustrates an example of the ground plane 102 having the circular waveguide 104. In the example of FIG. 2, the ground plane 102 includes a gap 204 between a top portion 206 and a base portion 202. The size of the gap can be varied as desired or needed.

Some examples of the ground plane 102 further include at least one horizontal protrusion 208 configured to redirect energy outwards or receive energy along an x-y plane 156 parallel to the ground plane 102. The x-y plane 156 is defined by the x-axis 150 and the y-axis 152. In such examples, the hemispherical coverage of the radiation pattern of the dielectric lens 108 is further broadened by the energy radiated outward or received along the x-y plane 156 by the at least one horizontal protrusion 208.

Some examples include a plurality of horizontal protrusions 208, such that x-y planes 156 are separated according to placement at various points on the z-axis 154 intersecting the ground plane 102. For example, a plurality of horizontal protrusions 208 can be arranged in a stacked configuration perpendicular to the z-axis 154, wherein each of the horizontal protrusions 208 aligns to a single one of the x-y planes 156. This stacked configuration further broadens the hemispherical coverage of the radiation pattern of the dielectric lens 108.

In operation, the ground plane 102 utilizes the circular waveguide 104 to direct energy (e.g., high frequency microwave radiation) through the gap 204 of the ground plane 102 directly into the dielectric lens 108, the gap 204 being hollow. The material properties of the dielectric lens 108 bend this energy outwards from the dielectric lens 108 in all directions, creating a radiation pattern with hemispherical coverage.

Referring now particularly to FIG. 3, a side elevational cutaway view illustrates an example of a dielectric lens 108 including a retaining ridge 304 in abutting engagement with a groove 302 of the ground plane 102. In the illustrated example, the ground plane 102 includes (e.g., is formed with) the groove 302, and the dielectric lens 108 includes (e.g., is formed with) the retaining ridge 304 having a rim 306. The groove 302 is configured to receive the rim 306 of the retaining ridge 304 therein to hold the dielectric lens 108 in abutting engagement with the ground plane 102. Such arrangement defines a ridge and groove configuration. It should be appreciated that the size, shape or complementary configuration of the ridge 304 and groove 302 can be modified as desired or needed. For example, the ridge 304 can be angled or formed to extend farther inward into a deeper groove 302.

The ridge 304 and groove 302 in some examples are configured to fit together in a snap-fit configuration. However, alternatively or optionally, the ridge 304 and groove 302 are coupled together with a bonding agent.

Figure 4:
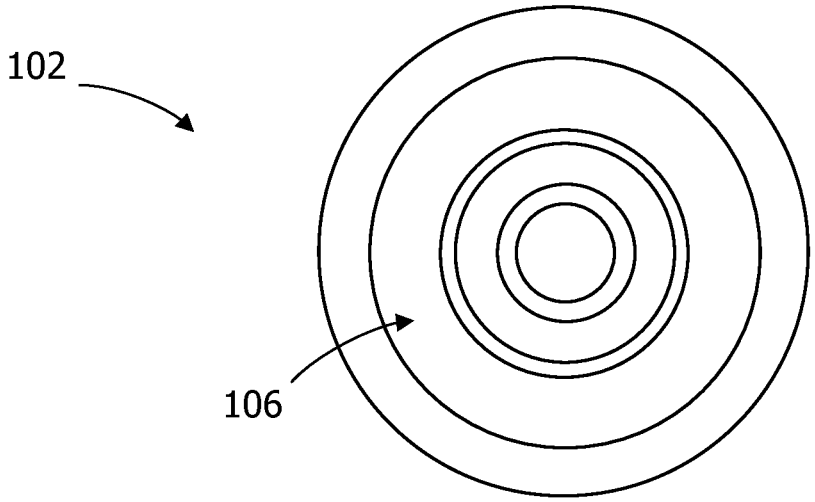
FIG. 4 is an exemplary top plan view of a ground plane according to an embodiment of the present disclosure.
Figure 5:
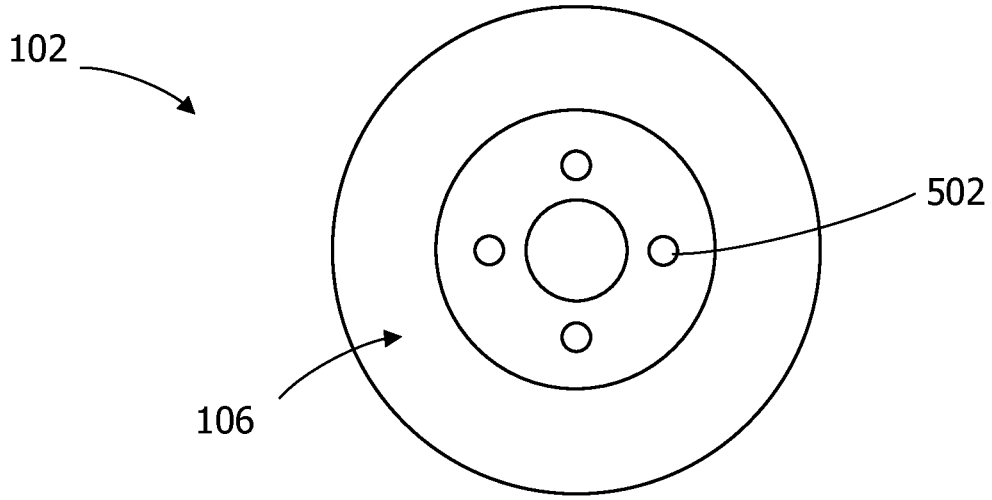
FIG. 5 is a bottom plan view illustrating a ground plane having a multi-hole circular waveguide interface according to an embodiment of the present disclosure.

FIG. 4 and FIG. 5 illustrate opposite (shown as top and bottom) plan views of the ground plane 102. Specifically, FIG. 4 is a top plan view of the ground plane 102, and FIG. 5 is a bottom plan view of the ground plane 102 including a multi-hole circular waveguide interface 502. In the example of FIG. 5, the ground plane 102 has the multi-hole circular waveguide interface 502 (having one or more threaded screw holes in some examples), such as for mounting to a support or base structure (e.g., mounting to a portion of a satellite). In some examples, the ground plane 102 is constructed of a precipitation-hardened alloy. Such examples constructed from precipitation-hardened alloys provide sufficient mechanical properties to survive deployment into long-term operations within the intended operating environment of the hemispherical antenna 100 without sustaining damage that would impede the function of the ground plane 102 within the hemispherical antenna 100. Such environments include, but are not limited to, low or medium earth orbits where communications satellites are routinely deployed. Such alloys include but are not limited to Rene 41 and 6061 precipitation-hardened aluminum alloy.

In some examples, the multi-hole circular waveguide interface 502 defines a flange structure with mechanical connection between the waveguide 104 and complementary portions (e.g., threaded holes) on an antenna. This configuration allows a proximate fitting between the components.

Figure 6:
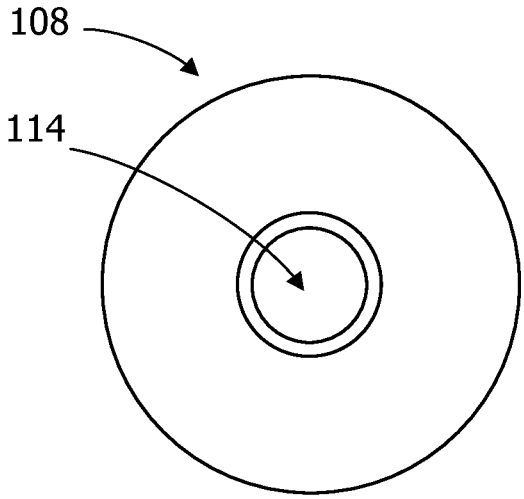
FIG. 6 is a top plan view illustrating a dielectric lens according to an embodiment of the present disclosure.
Figure 7:
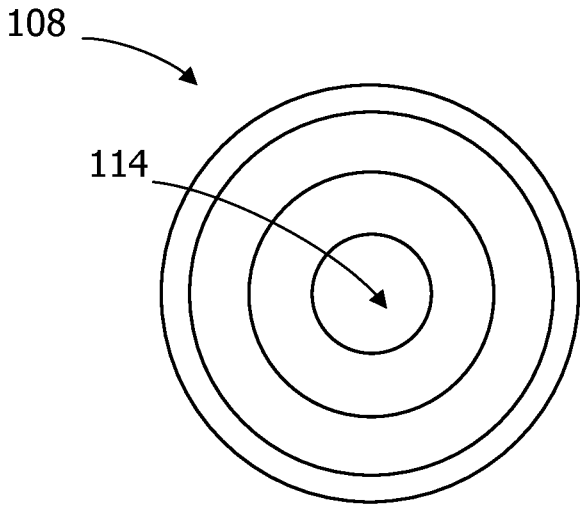
FIG. 7 is a bottom plan view of a dielectric lens according to an embodiment of the present disclosure.

FIG. 6 and FIG. 7 illustrate opposite (shown as top and bottom) plan views of the dielectric lens 108. Specifically, FIG. 6 is a top plan view of the dielectric lens 108, and FIG. 7 is a bottom plan view of the dielectric lens 108. In some examples, the dielectric lens 108 is constructed from a combination of materials with electromagnetic characteristics suitable for generating a hemispherical radiation pattern having a frequency in at least the Ka-band. In other examples, a single material is used. Construction materials utilized for the dielectric lens 108 can exhibit various degrees of translucency or transparency as is appropriate for the application. In other examples, the dielectric lens 108 is constructed at least partially from thermoplastic. Materials suitable for use in construction of the dielectric lens 108 vary depending on the intended application and include, but are not limited to, ABS-M30, acrylic glass, alumina, fused quartz; MACOR®, polyethylene, polypropylene, polystyrene, and TEFLON®.

In some examples, the dielectric lens 108 is constructed from an amorphous, thermoplastic polyetherimide ("PEI") resin. Some examples of the dielectric lens 108 constructed from PEI resin are constructed from ULTEM® 2300 ("Ultem 2300"), which are used in examples of the dielectric lens 108 configured for transmission and reception of high-frequency microwave band signals (e.g., in the Ka-band and above). For example, ULTEM® 2300 can be used for applications having deployment into and continuous operations within the vacuum of space. Additionally, ULTEM®

2300 includes consistent dielectric properties over a wide frequency range, such that this material is used when constructing various examples of the dielectric lens 108 configured to operate across a wide variety of microwave frequencies.

Generally, any dielectric material (solids, for the purposes of this disclosure) that can sustain an electric field and act as an insulator can be used in various examples. In operation, the more perfect a dielectric material, the less energy is lost from an electric field applied across the dielectric material. The more imperfect a dielectric material, the more lost energy from the applied field will manifest as heat. Because sensitive electronics, including the electronics used in antennas, generally have optimal temperature ranges for achieving the best performance and the longest operational lifetime, a dielectric material is selected with heat dissipation characteristics that fit the intended application. Example materials suitable for the dielectric lens 108 are discussed in more detail herein.

Figure 8:
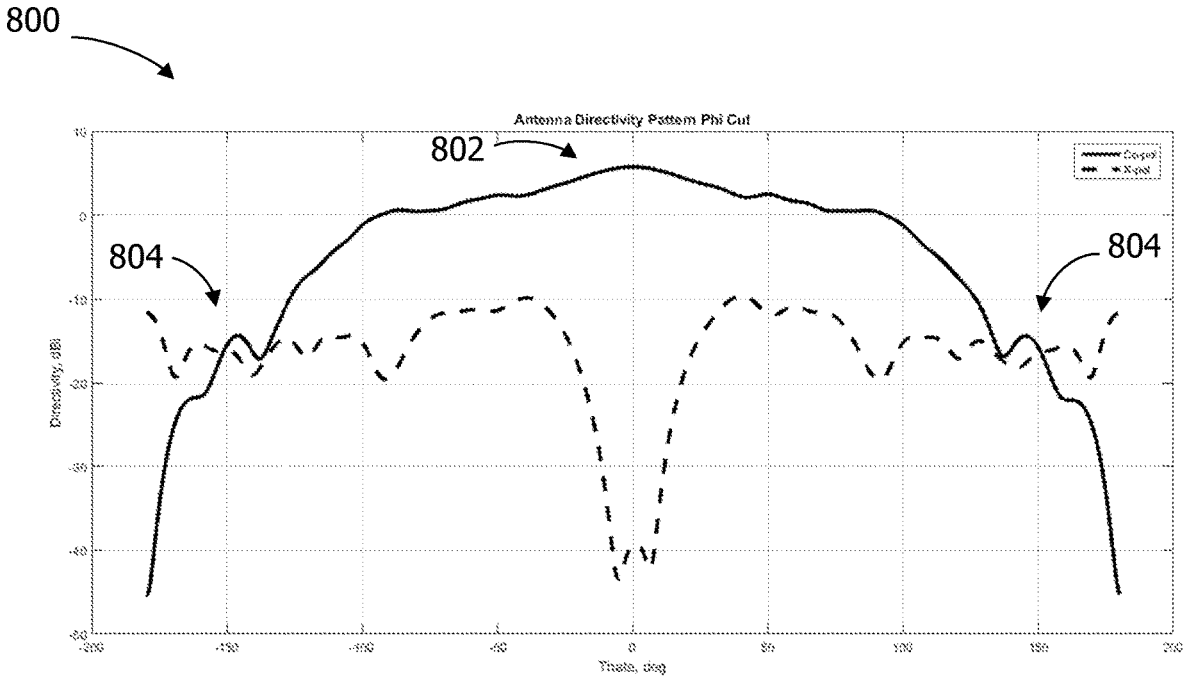
FIG. 8 is diagram illustrating a set of antenna radiation pattern cuts illustrating the performance of a waveguide hemispherical antenna configured for high-frequency microwave band reception according to an embodiment of the present disclosure.

Referring to FIG. 8, an antenna radiation pattern cut 800 produced by a dielectrically loaded waveguide hemispherical antenna, particularly, the hemispherical antenna 100, configured for high-frequency microwave band reception, specifically, at 30 GHz (within the Ka-band) is illustrated. The antenna radiation pattern cut 800 depicts a two-dimensional slice of the hemispherical radiation pattern of the hemispherical antenna (also called an antenna pattern), which is a pictorial depiction of the radiation properties of the hemispherical antenna as a function of space. The antenna radiation pattern cut 800 thus provides information on how the hemispherical antenna radiates energy out into (or receives energy from) the surrounding space, specifically the gain of the hemispherical antenna at a theta angle off the beam axis of the antenna. The beam axis is the axis of maximum radiation and found on the antenna radiation pattern cut 800 by the point on the x-axis where the theta angle has the value of zero degrees (a line representing the beam axis does not appear in FIG. 8). The theta angle is recorded in a plus-or-minus ninety-degree range off the beam axis, representing the full one-hundred-and-eighty-degree arc of the hemispherical antenna.

A gain of the hemispherical antenna at the given theta angle is recorded in terms of decibels isotropic (dBi), wherein the vertical axis represent gain and the horizontal axis represents the theta angle. The dBi indicates gain at a given theta angle in comparison to the gain of an isotropic radiator at the same theta angle. The dBi is represented in the antenna radiation pattern cut 800 by the y-axis. An isotropic radiator is a hypothetical lossless omnidirectional antenna, which provides the maximum possible gain at every possible theta angle. Representing the gain of a real-world antenna (e.g., the hemispherical antenna 100, the conventional hemispherical antenna design incorporating a parasitic crossed-dipole and dielectric support, or the conventional choke-pipe hemispherical antenna design) in terms of the gain in dBi at a given theta angle enables the observer to normalize and compare the gain and radiation pattern coverage of multiple real-world antennas of various types.

As an example, consider a hypothetical real-world antenna with the gain of −1.0 dBi at the theta angle of sixty degrees. At the theta angle of sixty degrees, this hypothetical real-world antenna thus has a gain 1.0 decibels less than the isotropic radiator at the same theta angle. Because the gain of the isotropic radiator is known at every theta angle value, the performance of the hypothetical real-world antenna is readily measurable in comparison to the dBi baseline.

The antenna radiation pattern cut 800 further depicts a plurality of the lobes within the radiation pattern. A lobe is any part of the pattern that is surrounded by regions of comparatively weaker radiation. The lobes depicted in the antenna radiation pattern cut 800 include a main lobe 802 containing the beam axis (representing the gain at various angles within the intended operational theta angle (which is in −90 degrees to +90 degrees range of the hemispherical antenna) and at least one back lobe 804.

Within the framework discussed above, the improved performance of examples of the disclosed hemispherical antenna, including examples of the hemispherical antenna 100, is readily apparent:

- Within the main lobe 802 of such examples of the disclosed hemispherical antenna configured to operate within the Ka-band at 30 GHz, the measured gain falls within a range of approximately 0.5 dBi at the boundary between the main lobe 802 and the at least one back lobe 804, and approximately 6.0 dBi at the beam axis within the main lobe. Thus, within the intended operational theta angle, the gain of the disclosed hemispherical antenna is never less than 0.5 dBi and is at most 6.0 dBi.
- By comparison, some examples of the contemporary hemispherical antenna design incorporating a parasitic crossed-dipole and dielectric support and configured to operate within the Ka-band at 30 GHz, exhibit a measured gain within a range of approximately −2.44 dBi to approximately 8 dBi.
- By further comparison, some examples of the contemporary choke-pipe hemispherical antenna design configured to operate within the Ka-band at 30 GHz exhibit a measured gain within a range of approximately −3 dBi to 8 dBi.

These examples illustrate that:

- The performance of hemispherical antennas according to the present disclosure configured to operate within the Ka-band at 30 GHz are at least commensurate with (and in some examples even superior to) some examples of the contemporary hemispherical antenna design incorporating a parasitic crossed-dipole and dielectric support and configured to operate within the Ka-band at 30 GHz; and
- The performance of hemispherical antennas according to the present disclosure configured to operate within the Ka-band at 30 GHz are demonstrably superior to some examples of the contemporary choke-pipe hemispherical antenna design configured to operate within the Ka-band at 30 GHz.

As described herein the performance characteristics are also provided in a more robust antenna design that is easier to manufacture.

Figure 9:
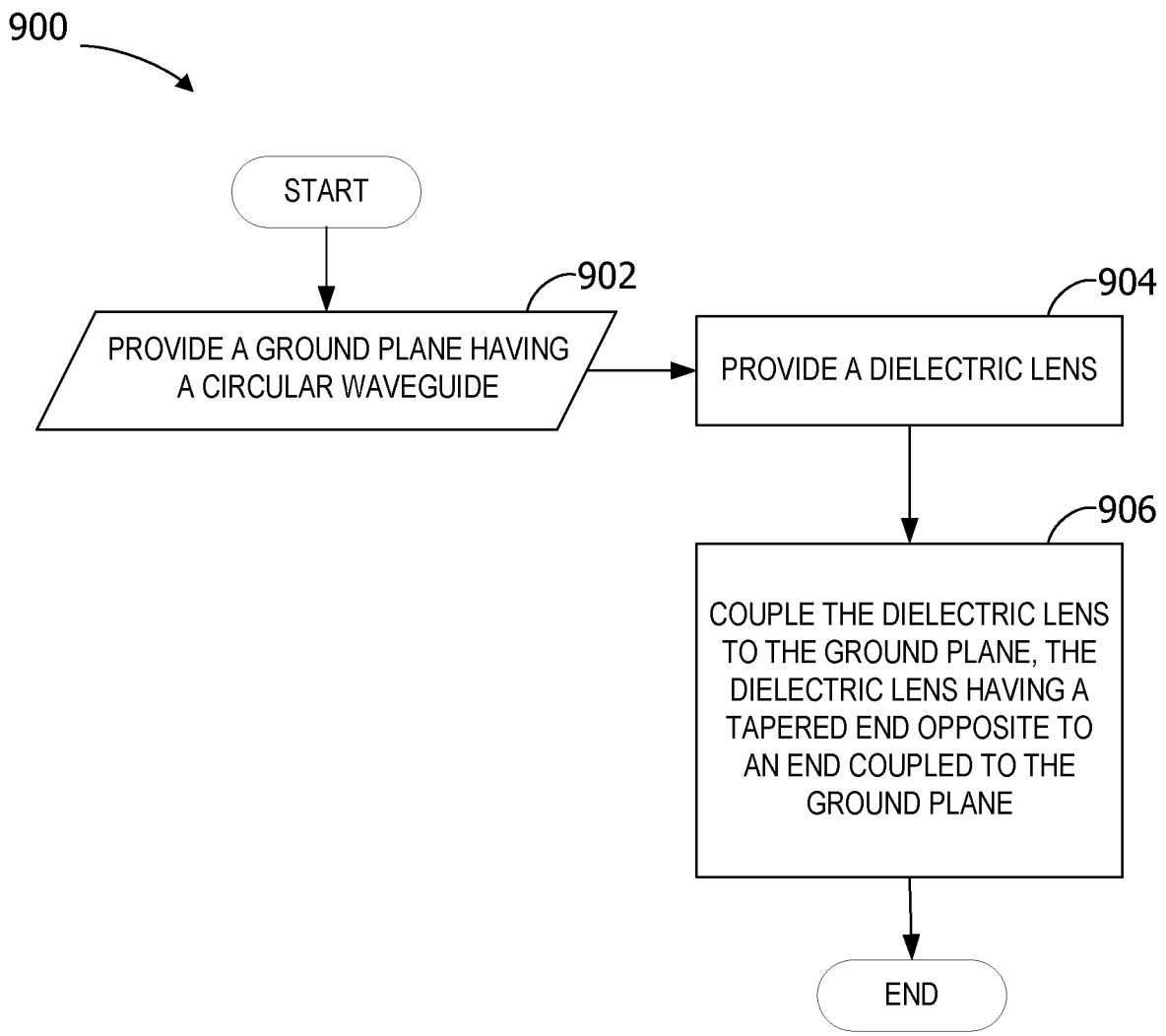
FIG. 9 is a flow chart illustrating a method to manufacture a hemispherical antenna according to an embodiment of the present disclosure.

FIG. 9 is an exemplary flow chart illustrating a method 900 to manufacture a dielectrically loaded waveguide hemispherical antenna. The process shown in FIG. 9 is usable to manufacture examples of the hemispherical antenna. The process begins by providing a ground plane having a circular waveguide at 902. For example, as described herein a ground plane with a gap and one or more protrusions, as described herein, is provided. The ground plane can be formed from a single unitary piece (e.g., molded deign) or can be formed from multiple components.

A dielectric lens is provided at 904. As described herein, a single dielectric lens is provided that is configured to couple to the ground plane. The single dielectric lens has at least a portion of an outer wall having a taper, as well as an inner diameter having a taper as described herein. The dielectric lens can be formed from a single unitary piece (e.g., molded deign) or can be formed from multiple components.

The dielectric lens is then coupled to the ground plane at 906. For example, as described herein, a snap-fit complementary configuration allows for abutting engagement of the ground plane and the dielectric lens with apertures of each being aligned when coupled together. In some examples, the process include bonding the dielectric lens to the ground plane at 906. Thereafter, the process is complete.

It should be appreciated that in some examples of the process illustrated by FIG. 9, the dielectric lens can be coupled to the ground plane using one or more of a number of approaches. Some examples employ a ridge and groove, while other examples employ a bonding agent. Still other examples employ a combination of a ridge and groove and a bonding agent. Other couplings not discussed herein can be used as well, so long as such couplings provide longevity and mechanical performance that meet the design goals of the specific application of the disclosure. In examples of the hemispherical antenna 100 manufactured using the process shown in FIG. 9, the dielectric lens has a tapered end opposite to an end coupled to the ground plane. Additionally, in some examples, the ground plane is metallic and the dielectric lens is non-metallic.

In some examples of the process illustrated by FIG. 9, the process further includes providing the dielectric lens to replace a dielectric support and a parasitic crossed-dipole element. In these examples, the process is usable to convert or replace an existing conventional antenna fitted with a dielectric support and a parasitic crossed-dipole element into an example of the hemispherical antenna 100.

Additional Examples

Examples of the disclosure provide antenna gain over a hemispherical radiation pattern coverage area for a spacecraft telemetry and command system operating at Ka-Band frequencies (or in some examples, higher microwave frequencies), while being simple to manufacture, assemble, and deploy. Construction of examples of the disclosed hemispherical antenna is simple. The hemispherical antenna 100 is comprised of two parts: the dielectric lens, and the ground plane with the integrated circular waveguide.

While examples of the disclosure are well-suited for applications in the high microwave frequency bands, properly configured examples of the disclosure are suitable to bring the advantages and benefits discussed herein to applications using any specific frequency band.

Depending on the requirements of a specific application, examples of the hemispherical antenna 100 disclosed herein can be configured to operate within various standardized frequency bands (e.g., the C-band, the V-band, the Ka-band, and the L-band). Other examples of the hemispherical antenna 100 disclosed herein alternatively can be configured to operate using various non-standardized frequency bands, for example, frequencies over 300 GHz. Yet other examples of the hemispherical antenna 100 disclosed herein can alternatively be configured to operate across any combination of standardized and or non-standardized frequency bands. Selection of a frequency band or bands for a specific example of the hemispherical antenna 100 disclosed herein depends upon the intended application.

The disclosure contemplates that constructed examples of the hemispherical antenna 100 disclosed herein are scalable to a physical size that is most appropriate for a given application. While examples of the hemispherical antenna 100 are configured to operate at a specific frequency (e.g., within the Ka-band) and are scalable to the specific size optimal to enable such operations depending on the application, the present disclosure does not limit either minimum or maximum constraints on the physical size of the hemispherical antenna 100, except as explicitly stated elsewhere herein. One of ordinary skill, informed by the principles of the present disclosure, will be able to adapt an embodiment to the specific size necessary for an application.

The disclosed hemispherical antenna 100 is configured as a dielectrically loaded waveguide hemispherical antenna that spreads out directed microwave radiation, thereby providing antenna gain within a hemispherical one-hundred-and-eighty-degree arc (plus-or-minus ninety-degrees off the beam axis), which either meets or exceeds the gain and radiation pattern performance of contemporary antenna designs discussed elsewhere herein. Temporarily or permanently configuring the example of the disclosed hemispherical antenna 100 for coordinated operation while arranged in space such that an omnidirectional antenna radiation pattern is achieved is readily practicable.

As is discussed elsewhere herein, examples of the disclosure are readily configurable to operate in a manner best suited for a variety of applications. Depending on the application, examples of the disclosure are usable without any computer assistance, as in the example of a hemispherical antenna coupled to a manually-controlled high-frequency microwave radio transceiver lacking any processor, memory, or other components capable of performing operations associated with a computer. In other applications, including satellite-based communications, examples of the disclosure are configurable to communicate with and receive instructions from computer systems containing, among other components, at least one processor and a memory. Such computer systems receive instructions from and relay data back to human operators, and the human operators in turn use the computer systems to control the disclosed antenna.

At least a portion of the functionality of the various elements in FIGS. 1-7 can be performed by other elements in FIGS. 1-7, or an entity (e.g., a multi-antenna hybrid satellite-terrestrial relay network) not shown in FIGS. 1-7.

In some examples, the operations illustrated in FIG. 9 are performed by a single person, a group of persons, a fully- or partially-automated assembly system, or any combination of the foregoing. For example, the ground plane having a circular waveguide and the dielectric lens can each be provided by distinct suppliers to a wholly separate assembler who couples the dielectric lens to the ground plane.

While the aspects of the disclosure have been described in terms of various examples with associated operations, a person skilled in the art should appreciate that a combination of operations from any number of different examples is also within scope of the aspects of the disclosure.

The term "Wi-Fi" as used herein refers, in some examples, to a wireless local area network using high frequency radio signals for the transmission of data. The term "BLUETOOTH®" as used herein refers, in some examples, to a wireless technology standard for exchanging data over short distances using short wavelength radio transmission. The term "cellular" as used herein refers, in some examples, to a wireless communication system using short-range radio stations that, when joined together, enable the transmission of data over a wide geographic area. The term "NFC" as used herein refers, in some examples, to a short-range high frequency wireless communication technology for the exchange of data over short distances. Unless explicitly stated otherwise, all radio frequency bands used for transmitting and receiving data named herein that are defined by the Institute of Electrical and Electronics Engineers ("IEEE") Standard 521-2002 (Standard Letter Designations for Radar-Frequency Bands), e.g.: Ka-band, L-band, V-band, etc. have the frequency ranges ascribed by that standard.

Exemplary Operating Environment

Figure 10:
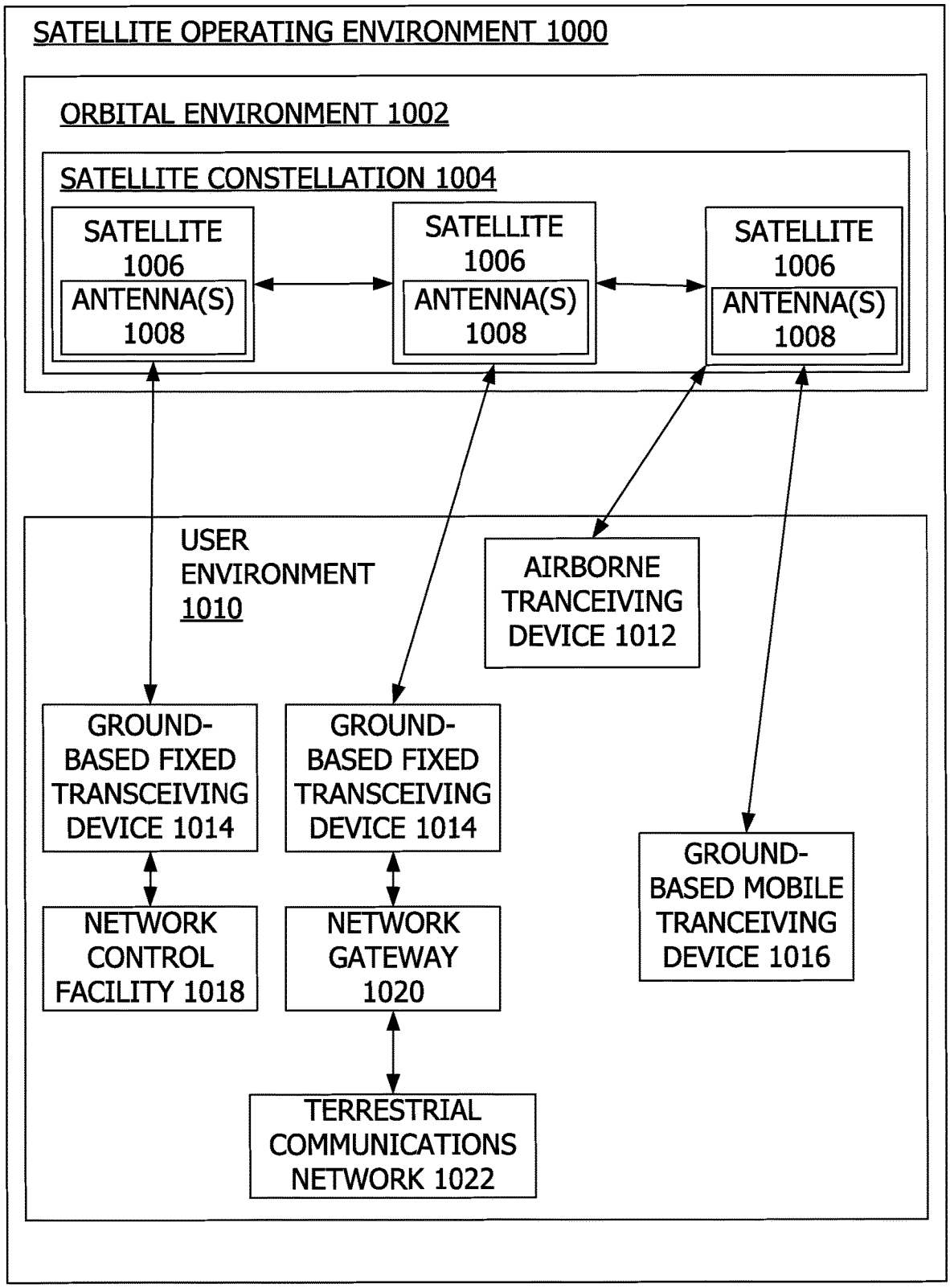
FIG. 10 is a block diagram illustrating a satellite operating environment implementing at least one waveguide hemispherical antenna according to an embodiment of the present disclosure.

The present disclosure is operable, for example, in a variety of terrestrial and extra-terrestrial environments for a variety of applications. For illustrative purposes only, and without limiting the possible operating environments in which examples of the disclosure operate, the following exemplary operating environment is presented. The present disclosure is operable within a satellite operating environment according to an embodiment as a functional bock diagram in FIG. 10. The satellite operating environment 1000 includes any Earth-centered (geocentric) orbit within which satellite deployment is practicable, the entirety of Earth's surface, and the entirety of Earth's airspace. Such orbits include but are not limited to: low Earth orbit ("LEO"); medium Earth orbit (MEO); geosynchronous orbit ("GEO"); and high Earth orbit ("HEO").

The satellite operating environment 1000 includes an orbital environment 1002. The orbital environment 1002 includes a three-dimensional geocentric region wherein an at least one satellite constellation 1004 is deployed. In some examples, the satellite constellation(s) 1004 is a plurality of human-made, artificial communications satellites 1006 working in concert under a centralized command and control such that the radiation pattern coverage area of each of the satellites 1006 overlaps to the maximum practicable extent to provide as much continuous coverage over as large an area of the Earth's total surface and airspace as possible.

Each of the plurality of satellites 1006 is includes at least one antenna 1008 configured to provide line-of-sight communications with transmitting and receiving entities on Earth's surface or within Earth's airspace. Each of the antennas 1008 of each of the satellites 1006 is configured to communicate using a specific radio frequency band, for example, the Ka-band. In some examples, depending on the intended application for each of the satellites 1006, each of the antennas 1008 is an example of the hemispherical antenna 100.

The satellite operating environment 1000 further includes a user environment 1010. The user environment 1010 includes a three-dimensional geocentric region including all of Earth's surface and airspace below the orbital environment 1002 and includes a plurality of transceiving devices. The plurality of transceiving devices is configured to send and receive data wirelessly by communicating directly with the plurality of satellites 1006, and the plurality of transceiving devices includes but is not limited to: an at least one airborne transceiving device 1012 (e.g., radio and telephony equipment temporarily or fixedly installed within an airplane, blimp, dirigible, helicopter, or other airborne or spaceborne vehicle); at least one ground-based fixed transceiving device 1014 (e.g., fixed satellite dishes and certain public telephone booths); and at least one ground-based mobile transceiving device 1016 (e.g., a cellular telephone). It should be noted that while one airborne transceiving device 1012 and two ground-based fixed transceiving devices 1014 are illustrated, different numbers of each can be provided.

In some examples, the at least one ground-based fixed transceiving device 1014 is communicatively coupled with at least one network control facility 1018 and/or at least one network gateway 1020. The network control facility 1018 provides a centralized command and control location for an entity maintaining and supporting the network defined by the satellite constellation 1004 and the plurality of transceiving devices within the user environment 1010 (the "satellite-ground network").

The network gateway 1020 provides a two-way communications interface between the satellite-ground network and an at least one terrestrial communications network 1022. In some examples, the terrestrial communications network 1022 is comprised of at least one of a plain old telephone system (POTS), a voice-over-IP ("VOIP") system, or any other telecommunications system that does not in isolation depend on the satellite-ground network to function. In such examples, the satellite-ground network facilitates wireless communications between the terrestrial communications network 1022 and transceiving devices outside the at terrestrial communications network 1022.

In examples wherein each of the plurality of satellites 1006 includes the hemispherical antenna 100 configured as disclosed herein, the at least one satellite constellation 1004 is usable to provide wireless communications for a high-speed, high-performance network implemented using one or a combination of high microwave frequencies, which include but are not limited to the Ka-band, L-band, and the V-band. Commercial examples of such networks include but are not limited to the INMARSAT® I-5 system, the upcoming IRIDIUM® Next system, and the James Webb Space Telescope's communications network, all of which employ the Ka-band. The exemplary O3B NETWORKS® mPOWER network discussed elsewhere herein employs the V-band. Such examples would be suitable applications for the hemispherical antenna 100. Such applications of the hemispherical antenna 100, when properly configured, can be immune to significant interference from terrestrial wireless networks, including but not limited to cellular networks and BLUETOOTH®-, Wi-Fi-, or NFC-based systems.

As described herein, the present disclosure provides systems and methods for constructing and deploying, for example within a communications system, a dielectrically loaded waveguide hemispherical antenna with improved performance characteristics that are capable of transmitting and receiving frequencies in the Ka-band and above. The systems and methods described herein efficiently and effectively construct and deploy within a communications system a dielectrically loaded waveguide hemispherical antenna suitable for use in a number of communications systems, including but not limited to the above exemplary operating environment. Additionally, the various examples described herein can be used in many different applications, such as in different land, air or sea applications.

While various spatial and directional terms, including but not limited to top, bottom, lower, mid, lateral, horizontal, vertical, front and the like are used to describe the present disclosure, it is understood that such terms are merely used with respect to the orientations shown in the drawings. The orientations can be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

As used herein, a material or component described using the terms "transparent" or "translucent" means that light can be transmitted through the material and emitted from another side of the material. The term "transparent" indicates a greater amount of light transmittance than the term "translucent," such that a transparent material will have less light distortion, diffusion, and/or attenuation than a translucent material. In this disclosure, the use of the term "translucent" to describe a material or component is not intended, unless explicitly stated, to exclude that the material can also be transparent. For example, a material or component described as "translucent" means that the material or component is at least translucent and can also be (but does not have to be) transparent.

The order of execution or performance of the operations in examples of the disclosure illustrated and described herein is not essential, unless otherwise specified. That is, the operations can be performed in any order, unless otherwise specified, and examples of the disclosure can include additional or fewer operations than those disclosed herein. For example, it is contemplated that executing or performing a particular operation before, contemporaneously with, or after another operation is within the scope of aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there can be additional elements other than the listed elements. The term "exemplary" is intended to mean "an example of." The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes can be made in the above constructions, products, and methods without departing from the scope of aspects of the disclosure, it is intended that all matter contained in the above description and shown in the accompanying drawings shall be interpreted as illustrative and not in a limiting sense.

It is to be understood that the above description is intended to be illustrative, and not restrictive. For example, the above-described embodiments (and/or aspects thereof) can be used in combination with each other. In addition, many modifications can be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are example embodiments. Many other embodiments will be apparent to those of ordinary skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

The following clauses describe further aspects:

Clauses

Clause Set A:

A1. A hemispherical antenna comprising:

a ground plane having a circular waveguide; and a dielectric lens coupled to the ground plane, the dielectric lens having a tapered end opposite to an end coupled to the ground plane.

A2. The hemispherical antenna of any preceding clause, wherein an aperture of the dielectric lens comprises a tapered aperture with a first diameter at the tapered end and a second diameter at the end coupled to the ground plane, wherein the first diameter is less than the second diameter.

A3. The hemispherical antenna of any preceding clause, wherein a diameter of the circular waveguide is greater than the second diameter of the dielectric lens.

A4. The hemispherical antenna of any preceding clause, wherein the ground plane comprises a gap between a top portion and a base portion.

A5. The hemispherical antenna of any preceding clause, wherein the ground plane comprises at least one horizontal protrusion configured to redirect energy outwards or receive energy along an x-y plane parallel to the ground plane;

whereby the hemispherical coverage of the radiation pattern of the dielectric lens is enhanced by the energy redirected outward or received along the x-y plane by the at least one horizontal protrusion.

A6. The hemispherical antenna of any preceding clause, wherein the ground plane comprises a groove and the dielectric lens comprises a retaining ridge having a rim, the groove configured to receive the rim of the retaining ridge therein to hold the dielectric lens in abutting engagement with the ground plane.

A7. The hemispherical antenna of any preceding clause, wherein the ground plane comprises a multi-hole circular waveguide interface.

A8. The hemispherical antenna of any preceding clause, wherein the ground plane is constructed of a precipitation-hardened alloy.

A9. The hemispherical antenna of any preceding clause, wherein the dielectric lens is constructed from a combination of materials with electromagnetic characteristics suitable for generating a hemispherical radiation pattern having a frequency in at least the Ka-band.

A10. The hemispherical antenna of any preceding clause, wherein the dielectric lens is constructed at least partially from thermoplastic.

A11. The hemispherical antenna of any preceding clause, wherein the dielectric lens is constructed from an amorphous, thermoplastic polyetherimide (PEI) resin.

Clause Set B:

B1. A hemispherical antenna comprising:

a ground plane having a circular waveguide; and a single dielectric lens coupled to the ground plane and not having a parasitic crossed-dipole element.

B2. The hemispherical antenna of any preceding clause, wherein the single dielectric lens is bonded to the ground plane.

B3. The hemispherical antenna of any preceding clause, wherein the ground plane and the single dielectric lens each have one tapered end.

B4. The hemispherical antenna of any preceding clause, wherein the ground plane comprises a multi-tier configuration defining a top hat-shaped profile.

B5. The hemispherical antenna of any preceding clause, wherein the ground plane and the single dielectric lens are configured to generate a hemispherical radiation pattern, the hemispherical radiation pattern having a frequency in at least the Ka-band.

B6. The hemispherical antenna of any preceding clause, wherein the ground plane and the single dielectric lens are configured to generate a hemispherical radiation pattern, the hemispherical radiation pattern having a frequency lower than those frequencies in the Ka-band.

Clause Set C:

C1. A method for manufacturing a hemispherical antenna, the method comprising:

providing a ground plane having a circular waveguide;

providing a dielectric lens; and coupling the dielectric lens to the ground plane, the dielectric lens having a tapered end opposite to an end coupled to the ground plane.

C2. The method of any preceding clause, further comprising bonding the dielectric lens to the ground plane.

C3. The method of any preceding clause, providing the dielectric lens to replace a dielectric support and a parasitic crossed-dipole element.

What is claimed is:

1. A hemispherical antenna comprising:

a ground plane having a circular waveguide; and a dielectric lens coupled to the ground plane, the dielectric lens having a tapered end opposite to an end coupled to the ground plane, wherein the ground plane is configured to deliver a non-hemispherical radiation wave front to the dielectric lens, and wherein the dielectric lens is configured to generate a hemispherical radiation pattern from the non-hemispherical radiation wave front.

2. The hemispherical antenna of claim 1, wherein an aperture of the dielectric lens comprises a tapered wall with a first diameter at the tapered end and a second diameter at the end coupled to the ground plane, wherein the first diameter is less than the second diameter.

3. The hemispherical antenna of claim 2, wherein a diameter of the circular waveguide is greater than the second diameter of the dielectric lens.

4. The hemispherical antenna of claim 1, wherein the ground plane comprises a gap between a top portion and a base portion.

5. The hemispherical antenna of claim 1, wherein:

the ground plane comprises at least one horizontal protrusion configured to redirect energy outwards or receive energy along an x-y plane parallel to the ground plane; and whereby a hemispherical coverage of a radiation pattern of the dielectric lens is enhanced by the energy redirected outward or received along the x-y plane by the at least one horizontal protrusion.

6. The hemispherical antenna of claim 1, wherein the ground plane comprises a groove and the dielectric lens comprises a retaining ridge having a rim, the groove configured to receive the rim of the retaining ridge therein to hold the dielectric lens in abutting engagement with the ground plane.

7. The hemispherical antenna of claim 1, wherein the ground plane comprises a multi-hole circular waveguide interface.

8. The hemispherical antenna of claim 1, wherein the ground plane is constructed of a precipitation-hardened alloy, wherein the dielectric lens further comprises a three-dimensional electromagnetic device that has a refractive index other than unity, which is configured as an electromagnetic lens.

9. The hemispherical antenna of claim 1, wherein the dielectric lens is constructed from a combination of materials with electromagnetic characteristics for generating a hemispherical radiation pattern having a frequency in at least a Ka-band, and the hemispherical antenna has only one waveguide.

10. The hemispherical antenna of claim 1, wherein the dielectric lens is constructed at least partially from thermoplastic.

11. The hemispherical antenna of claim 10, wherein the dielectric lens is constructed from an amorphous, thermoplastic polyetherimide (PEI) resin.

12. A hemispherical antenna comprising:

a ground plane having a circular waveguide; and a single dielectric lens coupled to the ground plane and not having a parasitic crossed-dipole element, wherein the ground plane is configured to deliver a non-hemispherical radiation wave front to the dielectric lens, and wherein the dielectric lens is configured to generate a hemispherical radiation pattern from the non-hemispherical radiation wave front.

13. The hemispherical antenna of claim 12, wherein the single dielectric lens is bonded to the ground plane.

14. The hemispherical antenna of claim 12, wherein the ground plane and the single dielectric lens each have one tapered end.

15. The hemispherical antenna of claim 12, wherein the ground plane comprises a multi-tier configuration defining a top hat-shaped profile.

16. The hemispherical antenna of claim 12, wherein the ground plane and the single dielectric lens are configured to generate a hemispherical radiation pattern, the hemispherical radiation pattern having a frequency in at least Ka-band frequencies.

17. The hemispherical antenna of claim 12, wherein the ground plane and the single dielectric lens are configured to generate a hemispherical radiation pattern, the hemispherical radiation pattern having a frequency lower than Ka-band frequencies.

18. A method for manufacturing a hemispherical antenna, the method comprising:

providing a ground plane having a circular waveguide;

providing a dielectric lens; and coupling the dielectric lens to the ground plane, the dielectric lens having a tapered end opposite to an end coupled to the ground plane and the ground plane configured to deliver a non-hemispherical radiation wave front to the dielectric lens, wherein the dielectric lens is configured to generate a hemispherical radiation pattern from the non-hemispherical radiation wave front.

19. The method for manufacturing a hemispherical antenna of claim 18, further comprising bonding the dielectric lens to the ground plane.

20. The method for manufacturing a hemispherical antenna of claim 18, further comprising providing the dielectric lens to replace a dielectric support and a parasitic crossed-dipole element.

* * * * *